US006492584B2

(12) United States Patent
Ikeya

(10) Patent No.: US 6,492,584 B2
(45) Date of Patent: Dec. 10, 2002

(54) APPARATUS AND METHOD FOR GENERATING OR CONTROLLING TONE ON THE BASIS OF A PLURALITY OF TONE GENERATOR UNITS OR TONE CONTROL UNITS

(75) Inventor: Tadahiko Ikeya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/808,513

(22) Filed: Mar. 14, 2001

(65) Prior Publication Data

US 2001/0022130 A1 Sep. 20, 2001

(30) Foreign Application Priority Data

Mar. 17, 2000 (JP) ..... 2000-077197

(51) Int. Cl.[7] ..... G10H 1/18
(52) U.S. Cl. ..... 84/615
(58) Field of Search ..... 84/615–620, 653–658, 84/645, 609–614, 649–652, 477 R, 478; 434/307 A

(56) References Cited

U.S. PATENT DOCUMENTS

| | | | | |
|---|---|---|---|---|
| 4,711,148 A | | 12/1987 | Takeda et al. | |
| 4,773,294 A | * | 9/1988 | Iizuka et al. | 84/615 X |
| 5,119,710 A | * | 6/1992 | Tsurumi et al. | 84/615 |
| 5,206,446 A | * | 4/1993 | Matsumoto et al. | 84/615 X |
| 5,260,508 A | * | 11/1993 | Bruti et al. | 84/615 X |
| 6,074,215 A | * | 6/2000 | Tsurumi | 84/609 X |
| RE36,910 E | * | 10/2000 | Nakata | 84/615 X |

* cited by examiner

*Primary Examiner*—Stanley J. Witkowski
(74) *Attorney, Agent, or Firm*—Morrison & Foerster LLP

(57) ABSTRACT

A plurality of units for generating or controlling a tone are used in an electronic musical instrument, the number of which is variable depending on a performance grade of the electronic musical instrument. There is supplied control information for generating or controlling a tone, such as performance event data. Each of the units has identification information defining control information to be used by the unit and determines, in accordance with the identification information, whether or not a tone signal based on the supplied control information is to be generated or controlled.

11 Claims, 4 Drawing Sheets

| MSB | | | | | | | | | | | | | | | | | LSB |
|---|---|---|---|---|---|---|---|---|---|---|---|---|---|---|---|---|---|
| ACTIONCODE | ※ | ※ | ※ | B | A#/Bb | A | G#/Ab | G | F#/Gb | F | E | D#/Eb | D | C#/Db | C |
| 1/0 | | | | 1/0 | 1/0 | 1/0 | 1/0 | 1/0 | 1/0 | 1/0 | 1/0 | 1/0 | 1/0 | 1/0 | 1/0 |

APPARATUS AND METHOD FOR GENERATING OR CONTROLLING TONE ON THE BASIS OF A PLURALITY OF TONE GENERATOR UNITS OR TONE CONTROL UNITS

BACKGROUND OF THE INVENTION

The present invention relates to an apparatus and method for generating or controlling tones which are used in electronic musical instruments, amusement equipment and other tone generating apparatus. For example, the present invention concerns an apparatus and method which are suitably applicable to electronic musical instruments that generate high-quality tone signals through parallel processing by a plurality of resources.

There have been known and used a great variety of electronic musical instruments, from low-performance-grade types that are inexpensive but have poor expressive power to high-performance-grade types that have superior expressive power. In high-performance-grade type electronic pianos, for example, a great many sorts of waveforms are prestored in memory in corresponding relation to various possible performance states and tone pitches, and the sampling frequency is set high. In low-performance-grade electronic pianos, on the other hand, only one or several sorts of waveforms are prestored in memory, and the sampling frequency is set low.

With the high-performance-grade types, it has been conventional to synthesize tone signals through parallel processing by a plurality of tone generator units, in order to secure necessary processing capabilities. Generally, the number of the tone generator units to be used in the parallel processing decreases as the performance grade lowers.

However, in the conventionally-known high-performance-grade type, each of the tone generator units has a different role, so that a dedicated tone generator unit must be provided for each of the roles. Also, in a situation where electronic musical instruments from a low-performance-grade type to a high-performance-grade type are to be constructed, a dedicated tone generator unit must be provided for each of the roles in each of the performance-grade types, because the role of each of the tone generator units also differs between the performance-grade types. As a consequence, a great number of the tone generator units have to be provided, which would unavoidably lead to increased costs.

SUMMARY OF THE INVENTION

It is therefore an object of the present invention to provide an apparatus and method which can greatly facilitate commonization of tone generator units or tone control units.

In order to accomplish the above-mentioned object, the present invention provides an apparatus for generating or controlling a tone, which comprises: a plurality of units for generating or controlling a tone; and a device that supplies control information for generating or controlling a tone, and wherein each of the units has identification information defining control information to be used by the unit and determines, in accordance with the identification information, whether or not a tone signal based on the supplied control information is to be generated or controlled.

The present invention also provides a method for generating or controlling a tone by use of a plurality of units for generating or controlling a tone, which comprises the steps of; supplying control information for generating or controlling a tone; presenting, for each of the units, identification information defining control information to be used by the unit: and determining, in accordance with the identification information, a particular one of the units which should use the control information supplied by the step of supplying.

Where the present invention is applied, for example, to an electronic musical instrument, the plurality of units to be used may be variable in number. However, the control information used here (such as performance event information based on the MIDI or other predetermined standard) can always be of same specifications irrespective of the variable total number of the units to be used; that is, the control information of the same specifications can always be used versatilely irrespective of the type (performance grade) of the electronic musical instrument. All of the units may be tone generation units, or tone control units such as effectors. Alternatively, the units may comprise a mixture of the tone generation and control units.

The present invention may be constructed and implemented not only as an apparatus invention but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, rather than a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF THE INVENTION

1. Hardware Setup of Embodiment

Figure 1:
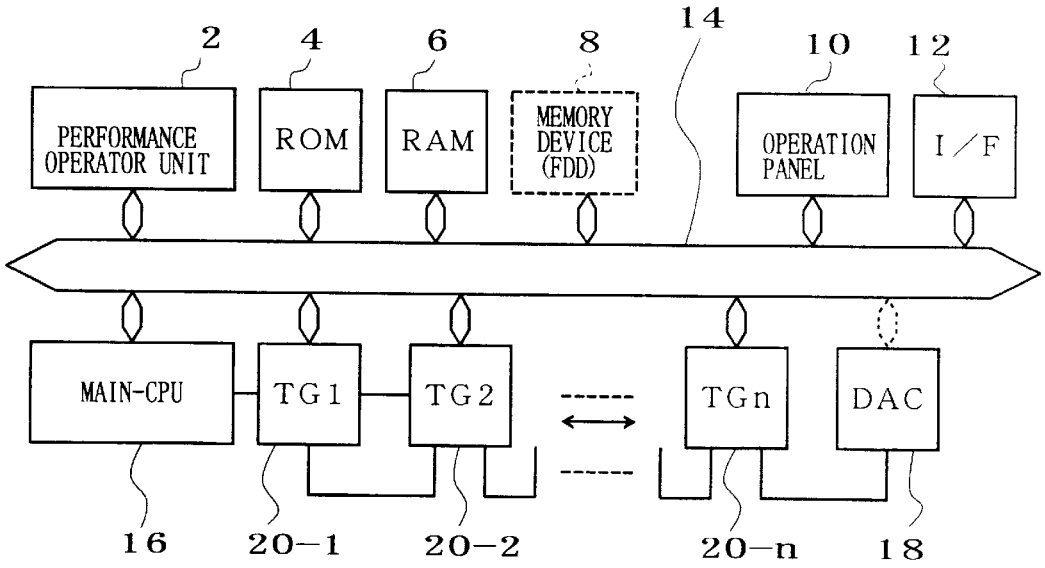
FIG. 1 is a block diagram showing a hardware setup of an electronic piano in accordance with an embodiment of the present invention.

FIG. 1 is a block diagram showing a hardware setup of an electronic piano in accordance with an embodiment of the present invention. As shown, the electronic piano includes a performance operator unit 2 including a keyboard, pedal, wheel, etc., and a main CPU 16 that controls various components of the instrument via a bus 14 on the basis of control programs stored in a ROM 4. Reference numeral 6 represents a RAM that is used as a working memory for the main CPU 16, and 8 represents a floppy disk drive provided as an optional attachment to the electronic piano. Reference numeral 10 represents an operation panel that can be operated by a user to input various instructions to the main CPU 16.

The electronic piano also includes a MD interface, via which MIDI signals are communicated between the electronic piano and external MIDI equipment such as a sequencer or external keyboard. Reference numerals 20-1 to 20-n represent n (n is an integral number greater than two) tone generator units which receive common or same performance information from the main CPU 16. Namely, the main CPU 16 supplies the tone generator units 20-1 to 20-n with same performance information on the basis of an operational state of the performance operator unit 2, information read out from a floppy disk via the floppy disk drive 8 or MIDI signal supplied via the MIDI interface 12. In the instant embodiment, such a process is never changed in accordance with the total number and respective assignments of the tone generator units 20-1 to 20-n.

The tone generator units 20-1 to 20-n are daisy-chained, each of which generates a tone signal in accordance with its assignment (i.e., role given to the unit). Here, each of the tone generator units 20-1 to 20-n time-divisionally multiplexes the tone signal generated thereby with the tone signal generated by the preceding unit, and then feeds the multiplexed result to the succeeding unit. Thus, the last tone generator unit 20-n will output a multiplexed tone signal representing a combination of the synthesized results of all the tone generator units 20-1 to 20-n. Reference numeral 18 represents a D/A converter (DAC) for converting the multiplexed tone signal into analog representation. The resultant analog tone signal is audibly reproduced or sounded via a sound system (not shown).

Figure 2:
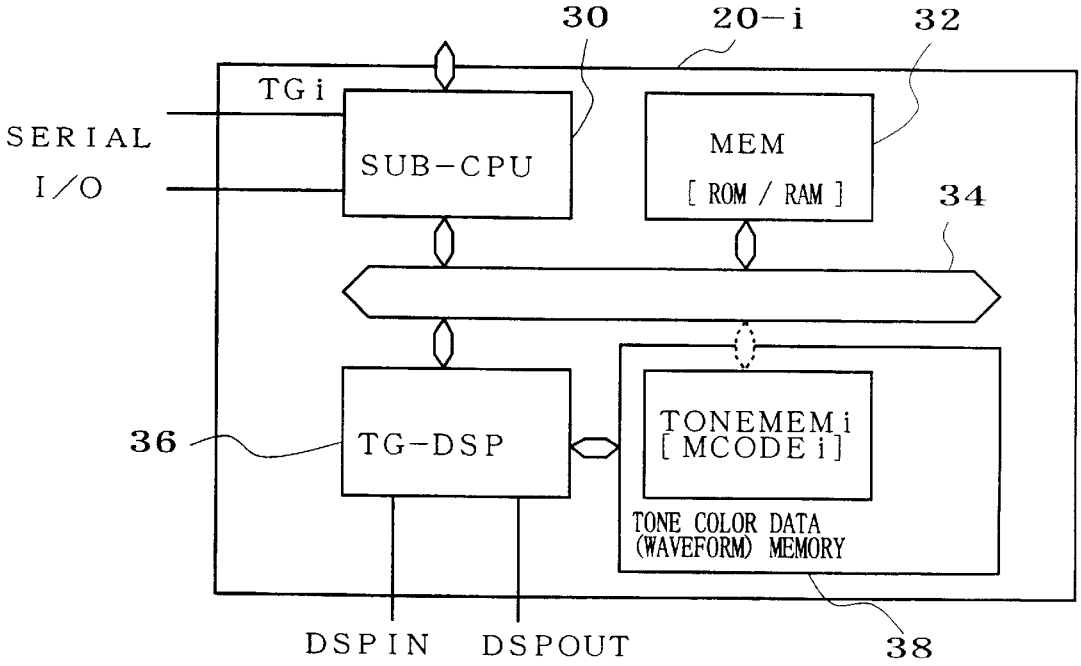
FIG. 2 is a block diagram showing an exemplary specific organization of a tone generator unit shown in FIG. 1.

The following paragraphs describe a specific organization of each of the tone generator units, with reference to FIG. 2. As shown, each of the tone generator units includes a sub-CPU 30 that controls various components of the unit via a bus 34 on the basis of performance information supplied from the main CPU 16. Reference numeral 32 represents a memory that is implemented by a ROM storing control programs (to be described later) for the sub-CPU 30 and a RAM for use as a working memory for the sub-CPU 30. Reference numeral 36 represents a tone generator DSP that synthesizes a tone signal on the basis of an instruction given from the sub-CPU 30.

The tone generator DSP 36 has an input terminal DSPIN for receiving a tone signal supplied from the preceding tone generator unit (i.e., the one immediately before the tone generator unit in question), and an output terminal DSPOUT for outputting a tone signal to be supplied to the succeeding tone generator unit. The tone signal output from the output terminal DSPOUT is a combination of the tone signal received at the input terminal DSPIN and tone signal synthesized by the tone generator DSP 36. Reference numeral 38 represents a tone color data memory which stores therein various waveform data to be used for a tone synthesization process in the tone generator DSP 36 and other tone color data.

2. Organization of Data Employed in Embodiment

Figures 3, 6:
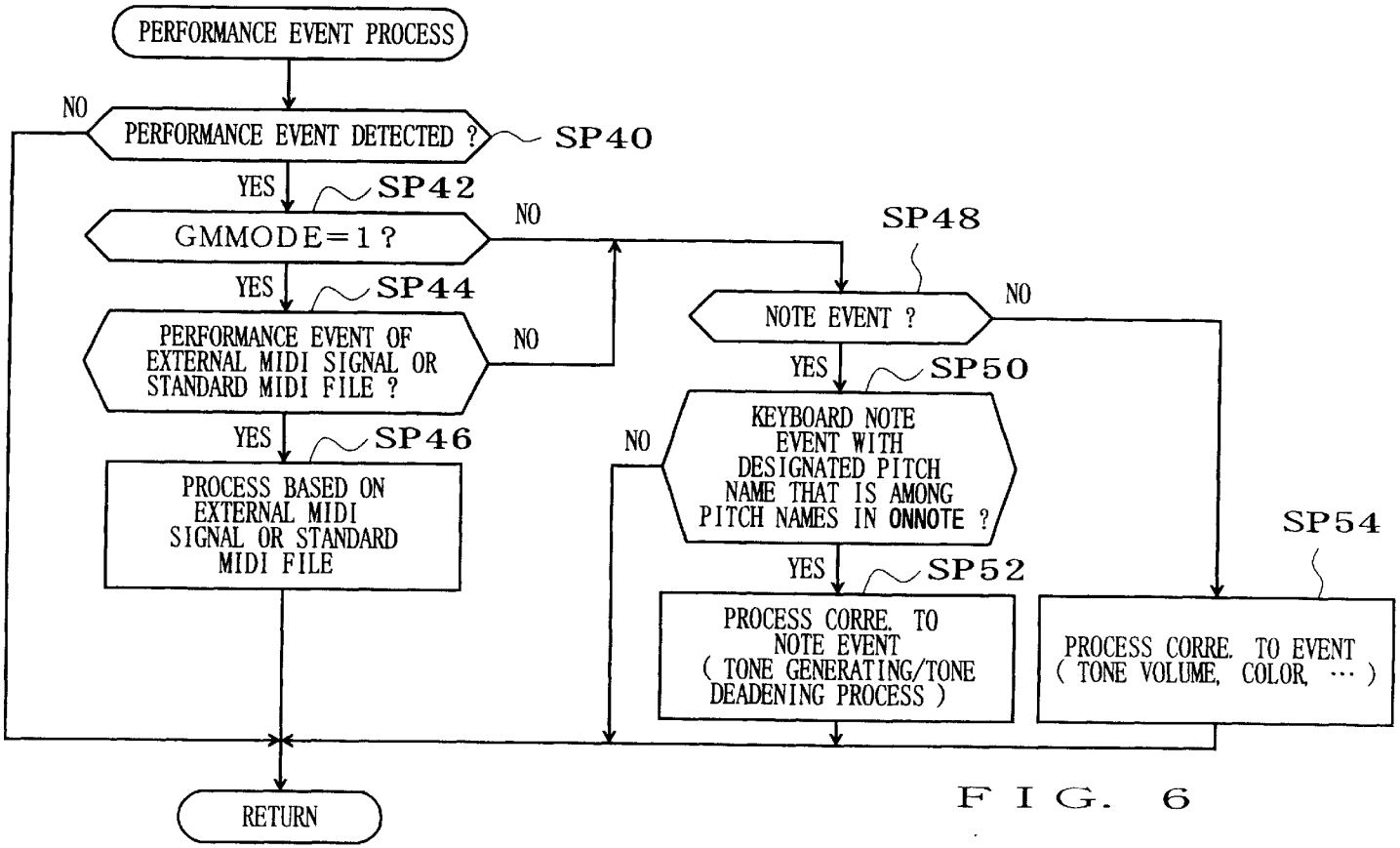
FIG. 3 is a diagram showing an exemplary format of MCODE data used in the embodiment.
FIG. 6 is a flow chart showing a performance event process routine for execution by the sub-CPU.

In the above-mentioned tone color data memory 38, 16-bit data called "MCODE" is stored at a predetermined address, as. shown in FIG. 3. Highest-order bit (MSB: Most Significant Bit) of the MCODE data is referred to as an ACTIONCODE bit, which indicates whether or not the tone generator unit in question is to be used as a standard tone generator unit based on the GM (General MIDI) or XG standard, and more specifically whether or not the tone generator unit in question is to be used for synthesis of accompaniment tones. Whereas the electronic piano in accordance with the instant embodiment is used primarily for piano tone synthesis, it can also generate accompaniment tones with various tone colors of percussion instruments and wind instruments, by being provided with such a tone generator unit for accompaniment tones.

The second to fourth bits of the 16-bit MCODE data are ignored. The fifth to sixteenth bits, which are called NOTECODE bits, correspond to a total of 12 pitch names (B, A# or B♭, . . . , C). In the NOTECODE bits, a value "1" is stored for each pitch name to be synthesized by the tone generator unit in question, while a value "0" is stored for the other pitch names. The following are two exemplary groups of settings of the MCODE data: one group for a high-performance-grade type electronic piano provided with seven tone generator units; the other group for a medium-performance-grade type electronic piano provided with four tone generator units.

<Settings for High-performance-grade Type Electronic Piano>

- tone generator unit 20-1: the B and A# (or B♭) NOTECODE bits are set to "1", while the other bits are set to "0",
- tone generator unit 20-2: the A and G# (or A♭) NOTECODE bits are set to "1", while the other bits are set to "0",
- tone generator unit 20-3: the G and F# (or G♭) NOTECODE bits are set to "1", while the other bits are set to "0",
- tone generator unit 20-4: the F and E NOTECODE bits are set to "1", while the other bits are set to "0",
- tone generator unit 20-5: the D# (or E♭) NOTECODE bits are set to "1", while the other bits are set to "0",
- tone generator unit 20-6: the C# (or D♭) NOTECODE bits are set to "1", while the other bits are set to "0", and
- tone generator unit 20-7: the ACTIONCODE bit is set to "1", while the other bits are set to "0".

<Settings for Medium-performance-grade type Electronic Piano>

- tone generator unit 20-1: the B and A# (or B♭), A and G# (or A♭) NOTECODE bits are set to "1", while the other bits are set to "0",
- tone generator unit 20-2: the G and F# (or G♭), F and E NOTECODE bits are set to "1", while the other bits are set to "0",
- tone generator unit 20-3: the D# (or E♭), D and C# (or D♭) and C NOTECODE bits are set to "1", while the other bits are set to "0", and
- tone generator unit 20-4: the ACTIONCODE bit is set to "1", while the other bits are set to "0".

In the high-performance-grade type electronic piano thus arranged, each of the first to sixth tone generator units 20-1 to 20-6 is assigned to or responsible for synthesis of piano tones of two pitch names, and the seventh tone generator unit 20-7 is assigned to or responsible for synthesis of accompaniment tones. In the medium-performance-grade type electronic piano, on the other hand, each of the first to third tone generator units 20-1 to 20-3 is assigned to synthesis of piano tones of four pitch names, and the fourth tone generator unit 20-4 is assigned to synthesis of accompaniment tones. The reason why the roles of the tone generator units are divided according to the pitch names is as follows.

In the conventionally-known electronic pianos, roles of a plurality of tone generator units are set for each predetermined range (i.e., for each range of consecutive pitch names on a tone-pitch axis). However, because performance events tend to center on one or more specific ranges depending on the form of a performance, there would arise the problem that loads are concentrated on one or more specific ones of the tone generator units. To avoid such a problem, the roles of the tone generator units in the instant embodiment are set according to the pitch names in such a manner that the pitch ranges allotted to the individual units are distributed on the tone-pitch axis. Such pitch range allotment can substantially uniformize the loads on the individual tone generator units.

3. Behavior of the Embodiment 3.1. Main CPU 16

The instant embodiment behaves as follows. Upon power-on of the electronic piano, the main CPU 16 carries out a predetermined initialization process and then keeps monitoring operational states of the performance operator unit 2 and MIDI interface 12. Whenever any new event is detected in the performance operator unit 2 or MIDI interface 12, the main CPU 16 transmits information indicative of the detected event to each of the tone generator units 20-1 to 20-n.

In the case where the electronic piano is provided with the floppy disk drive 8 and when the user performs a predetermined operation on the operation panel 10 a performance information file (e.g., SMF: Standard MIDI file) is read out from the floppy disk set in that floppy disk drive 8. Then, on the basis of the read-out performance information file, the main CPU 16 sequentially supplies event information to each of the tone generator units.

3.2. Sub-CPU 30

Figure 4:
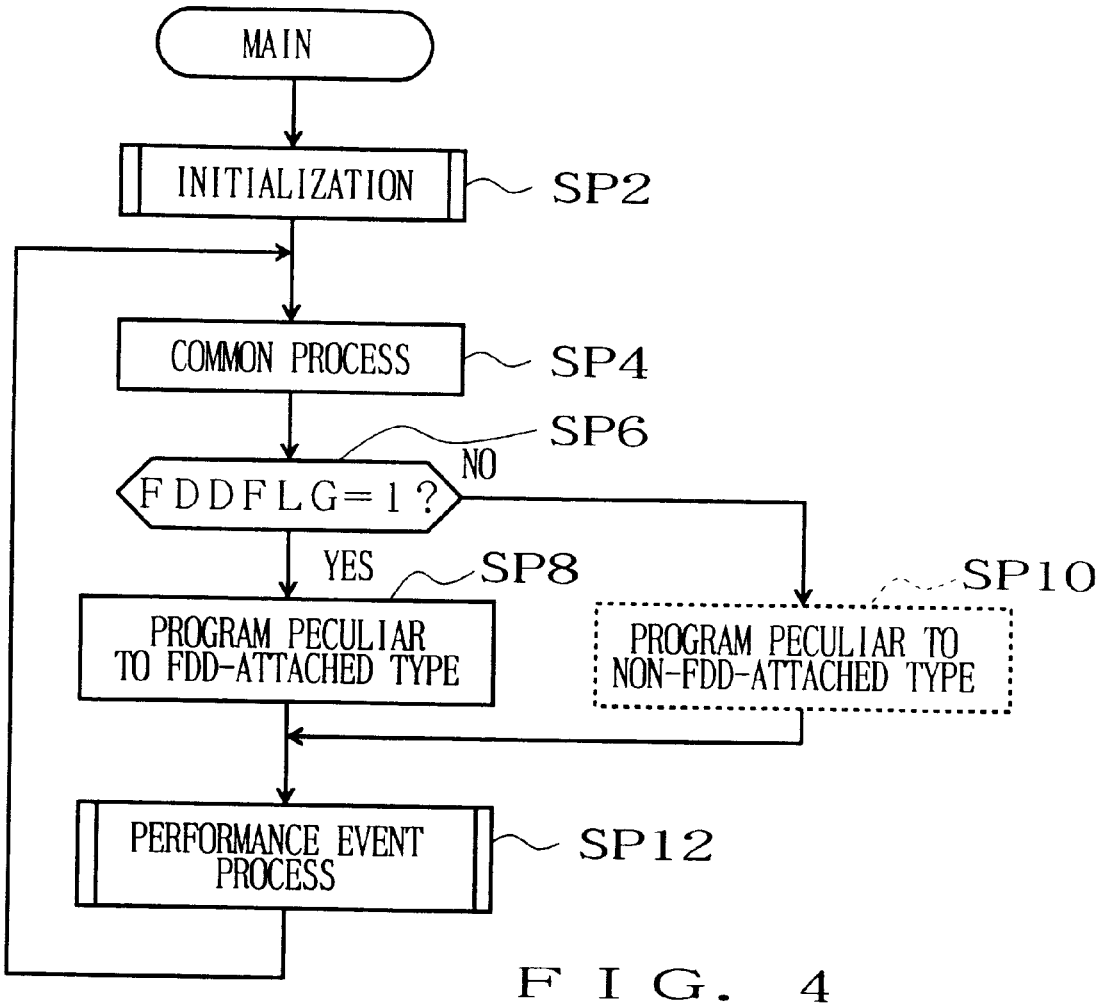
FIG. 4 is a flow chart showing a main routine for execution by a sub-CPU in the embodiment.
Figure 5:
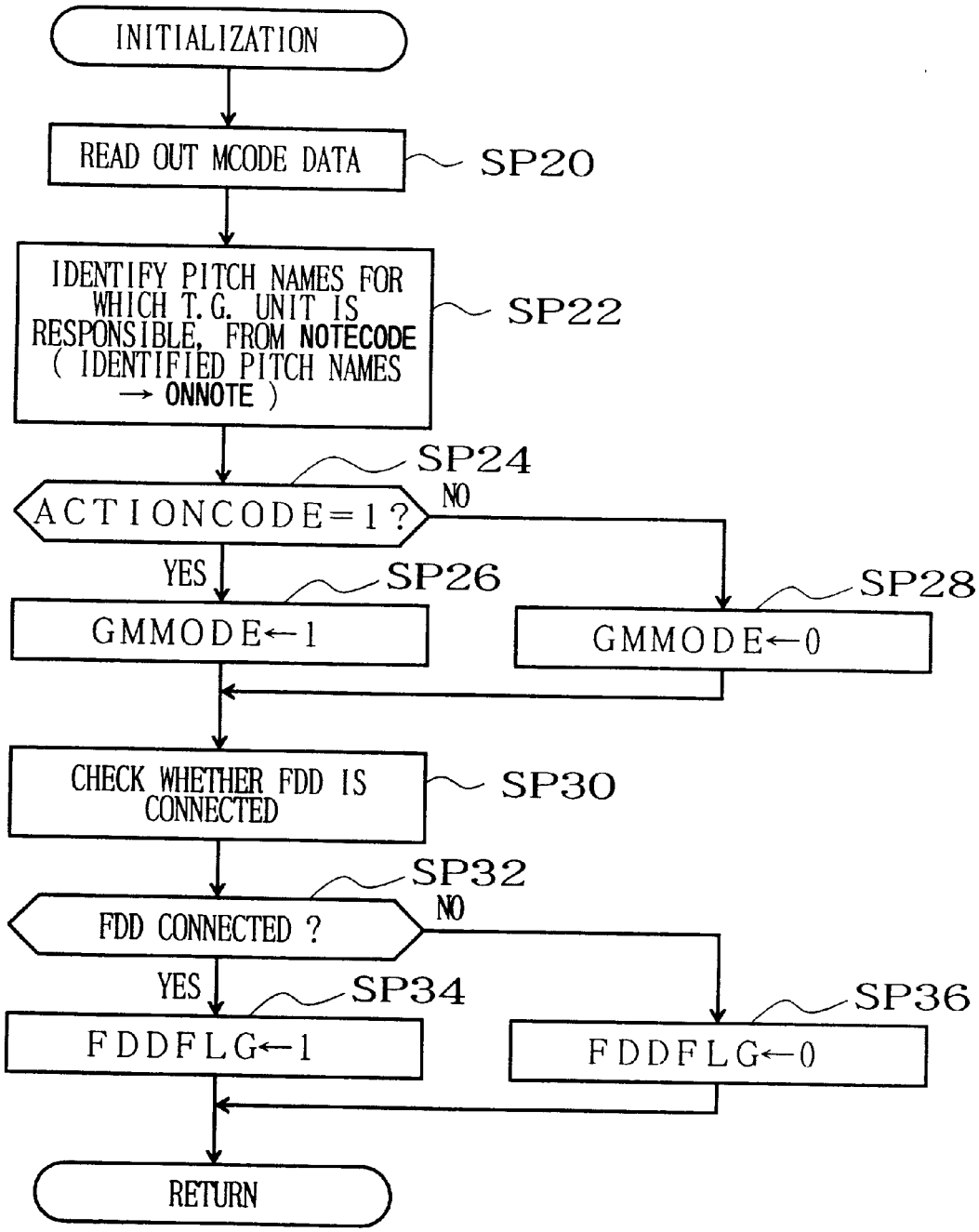
FIG. 5 is a flow chart showing an initialization routine for execution by the sub-CPU.

When the power to the electronic piano is turned on, a main routine of FIG. 4 is started up in the sub-CPU 30 of each of the tone generator units. At step SP2 of the main routine, an initialization routine of FIG. 5 is invoked. At step SP20 of the initialization routine, the MCODE data is read out from the tone color data memory 38. At next step SP22, the pitch names for which the tone generator unit in question is responsible are identified on the basis of the NOTECODE bits of the read-out MCODE data.

The thus-identified pitch names are added as elements to a note array ONNOTE. Note that if all the NOTECODE bits are "0", the note array ONNOTE is made up of a succession of element values "0". At next step SP24, a determination is made as to whether the ACTIONCODE bit of the MCODE data is "1" or not. If answered in the affirmative at step SP24, i.e. if the tone generator unit in question is one responsible for synthesis of accompaniment tones, the initialization routine proceeds to step SP26, where a flag GMMODE is set to a value "1". If answered in the negative at step SP24, i.e. if the tone generator unit in question is one responsible for synthesis of piano tones, the initialization routine branches to step SP28, where the flag GMMODE is set to a value "0".

Then, the routine proceeds to step SP30, where a determination is made as to whether or not the floppy disk drive 8 is attached or connected to the electronic piano. With an affirmative (YES) determination at step S30, the routine moves on to step SP34 in order to set a flag FDDFLG to "1". With a negative determination, however, the routine branches to step SP36 in order to set the flag FDDFLG to "0". After that, the initialization routine returns to the main routine of FIG. 4.

At step SP4 of the main routine shown in FIG. 4, a common process is carried out irrespective of whether the floppy disk drive 8 is attached to the electronic piano or not. At next step SP6, a determination is made as to whether the flag FDDFLG is at "1" or not. If the floppy disk drive 8 is attached as determined at step SP6, the main routine goes to step SP8 in order to execute a program peculiar to the type of electronic piano equipped with the floppy disk drive 8 (FDD-attached type).

If, on the other hand, the floppy disk drive 8 is not attached as determined at step SP6 (NO determination), the main routine branches tp step SP10 in order to execute a program peculiar to the type of electronic piano equipped with no floppy disk drive (non-FDD-attached type). Differences between steps SP8 and SP10 reside in whether or not data are communicated between the electronic piano and the floppy disk, in contents of an automatic performance/accompaniment function, in contents of manipulations detected on the operation panel 10, in contents displayed on the operation panel 10, or the like. After step SP8 or SP10, the main routine moves on to step SP12, where a performance event process routine of FIG. 6 is invoked. This performance event process is carried out in a manner differing depending on the contents of the MCODE data stored in the tone color data memory 38, as described hereinbelow.

3.2.1 in the Case of the Tone Generator Unit for Piano Tones:

At step SP40 of FIG. 6, a determination is made as to whether or not any new event information has been supplied from the main CPU 16. With a negative (NO) determination, the performance event process routine is immediately brought to an end. With an affirmative (YES) determination, the performance event process routine moves on step SP42. At step SP42, it is determined whether the flag GMMODE is at "1". Because the flag GMMODE has been initialized to "0" in the tone generator unit for piano tones, a NO determination is made here, so that the routine branches to step SP48. Operations after step SP48 differ depending on the sort of the event information supplied from the main CPU 16, as explained below.

(1) Note Event:

At step SP48, a determination is made as to whether the supplied event information is indicative of a note event (i.e., note-on or note-off event). If answered in the affirmative, the routine goes to step SP50, where a further determination is made as to whether the note event is one having occurred in the keyboard (i.e., keyboard note event) and a pitch name designated in the event is among those in the note array ONNOTE.

If answered in the affirmative at step SP50, the routine proceeds to step SP52, where a process corresponding to the keyboard note event is carried out. Specifically, a tone generating instruction or tone deadening (silencing) instruction is given to the tone generator DSP 36. In accordance with the tone generating instruction or tone deadening instruction, the tone generator DSP 36 starts synthesizing a tone signal or performs a tone deadening process. The tone signal thus synthesized by the tone generator DSP 36 is delivered to the D/A converter 18 via the succeeding tone generator unit (if any) so that it is audibly reproduced via the sound system.

If, however, the note event is one having occurred in another component than the keyboard, or if the note event is a keyboard note event but the designated pitch name is not among those in the note array ONNOTE, then a NO determination is made at step SP50, so that the performance event process routine is brought to an end without performing the tone generating/tone deadening process. As a result, even though the same keyboard event is transmitted from the main CPU 16 to all the tone generator units 20-1 to 20-n, it is only one of the tone generator units that is caused to synthesize a tone signal corresponding to the event.

(2) Event Other Than Note Event:

In the event that the event information supplied from the main CPU 16 is indicative of an event other than the note event, a negative determination is made at step SP48, so that the routine branches to step SP54, where a process corresponding to the event information is carried out. Specifically, the event information indicative of an event other than the note event, according to the GM standard, concerns a control change such as a pedal manipulation, channel volume or master volume. Namely, if the supplied event information is indicative of a control change of a piano tone (bank select) responsive to a pedal manipulation, a process, such as waveform data switching or changeover, is carried out simultaneously in all the tone generator units 20-1 to 20-n, on the basis of the supplied event information. If the supplied event information is indicative of a master volume event or channel volume event of a piano tone, all the tone generator units for piano tones are caused to simultaneously perform a tone volume raising/lowering process.

3.2.2. in the Case of the Tone Generator Unit for Accompaniment Tones:

(1) Event of MIDI File or External MIDI Signal:

As noted earlier, the flag GMMODE has been initialized to "1" in the tone generator unit for accompaniment tones. Thus, once the performance event process routine is invoked, it proceeds to step SP44 by way of steps SP40 and SP42. At step SP44, a determination is made as to whether or not the event information belongs to either a MIDI file read out via the floppy disk drive 8 or an external MIDI signal input via the MIDI interface 12. If answered in the affirmative at step SP44, the routine moves on to step SP46 in order to carry out a process based on the MIDI file or external MIDI signal; for example, a tone signal is generated which represents an accompaniment tone of a percussion instrument or wind instrument.

(2) Note Event of Keyboard:

If the event information is indicative of a note event of the keyboard, a NO determination is made at step SP44, so that the routine proceeds to step SP50 by way of step SP48. In the tone generator unit for accompaniment tones employed in the high-performance-grade or medium-performance-grade type electronic piano as set forth above, all the NOTECODE bits in the MCODE data are "0", and thus the note array ONNOTE is an empty array. Therefore, a NO determination is always made at step SP50, so that the performance event process routine is brought to an end without performing any substantial operation.

(3) Event of Performance Operator Unit 2 Other than Note Event:

If the event information is indicative of an event of the performance operator unit 2 other than the note event, then the routine goes to step SP54 by way of steps SP44 and SP48. Therefore, in the event that the event information indicates a control change of the master volume, the volume of the accompaniment tone is raised or lowered simultaneously with the volume change in the tone generator units for piano tones 20-1 to 20-(n−1). Further, in the event that the event information concerns a channel volume or bank select of a tone color being currently synthesized, operations for making a tone volume increase/decrease, parameter change, etc. are performed on the tone color irrespective of the tone generator units for piano tones.

4. Benefits Afforded by the Embodiment

With the embodiment of the invention arranged in the above-described manner, differences among the tone generator units employed in various type of electronic pianos, from the low-performance-grade type to high-performance-grade type, can be limited only to the tone color data memory 38 storing waveform data and MCODE data. Also, because most of other hardware and software components can be shared among the tone generator units, it is possible to eliminate the time and labor for applying different designs to the individual tone generator units in the different types of electronic pianos, so that inventory control during manufacture of the electronic pianos can be greatly facilitated. Further, the overall cost can be reduced significantly because it only suffices to mass-produce tone generator units of the same configuration.

5. Modifications

The present invention should not be construed as limited to the above-described embodiment, and various other embodiments or modifications of the invention are also possible as stated below.

(1) The embodiment has been described above in relation to the case where six or three tone generator units are assigned to synthesis of piano tones and one tone generator unit is assigned to synthesis of accompaniment tones. However, it should be obvious that the present invention is not limited to such a number and assignment of the tone generator units; any other suitable number and assignment of the tone generator units may be chosen depending on which tone color is to be reproduced with higher priority or how many tone generator units can be used from the viewpoint of the cost.

For example, a tone generator unit dedicated to violin tone synthesis may be added in a situation where violin tones, in addition to piano tones, are to be reproduced with higher priority. Because tone pitches vary continuously for each of a plurality of strings on the violin, it is preferable that different tone generator units be assigned in corresponding relation to the strings. In such a case, four extra bits corresponding the four strings (G, D, A and E) of the violin may be added to the MCODE data. In the case where there is only one tone generator unit dedicated to violin tone synthesis, the four extra bits are all set to "1", but in the case where there are two tone generator units dedicated to violin tone synthesis, every two bits of the four extra bits are set to "1".

(2) Further, whereas the embodiment has been described above in relation to the case where the tone generator units for piano tones are assigned in accordance with the pitch names in such a manner that the pitch names allotted to the individual tone generator units are distributed on the tone-pitch axis, the tone generator units for piano tones may be assigned in accordance with other factors than the pitch names; for example, where there are five tone generator units for piano tones, these tone generator units may be assigned in accordance with remainders obtained by dividing key codes by "5".

Further, although the benefit of the invention that loads on the individual tone generator units can be generally uniformized may be slightly sacrificed, the roles of the tone generator units may be set in accordance with ranges (ranges of consecutive pitch names on the tone-pitch axis). In this case, the overall range of the piano tones may be divided into six regions and six-bit data may replace the NOTECODE bits of the MCODE data so that the respective roles of the tone generator units can be set in accordance with values in these bits.

(3) Further, the MCODE data may be instrument type information that is indicative of the unit No. of the tone generator unit in question and performance-grade type of the electronic piano to which the tone generator unit belongs, rather than information directly indicating the role allotted to the tone generator unit. In this case, the specific role of each of the tone generator units may be identified on the basis of such instrument type information and the program stored in the ROM of the memory 32. In this case too, the same hardware and software components, except for the tone color data memory 38, can be commonized or shared among the tone generator units.

(4) Furthermore, although the embodiment has been described as storing the MCODE data at predetermined addresses of the tone color data memory 38, the MCODE data may be stored at any other desired addresses and a pointer to the desired addresses may be stored at any of the predetermined addresses. Moreover, the MCODE data may be text data in the ASCII, JIS or other format, rather than being the bit pattern as described above.

(5) Furthermore, whereas the embodiment has been described above in relation to the case where the tone generator units are memory-based tone generators, the tone generator units employed in the present invention may be FM or physical model tone generators. In such a case, parameters corresponding to the type of the tone generator are stored, in place of the waveform data, in the tone color data memory 38 of that unit.

(6) Furthermore, any desired one (or ones) of the tone generator units may be an effector unit rather than the tone generator. Namely, any desired tone generator can be caused to operate as an effector by the DSP 36 being supplied with microprograms and parameters for implementing the effector. Specifically, such an effector unit is provided between one of the tone generator units and the D/A converter 18, so as to perform an effect process on the multiplexed tone signal and thereby supply the effect-imparted multiplexed tone signal to the D/A converter 18. Also, an extra bit indicating whether the unit in question is a "tone generator" or an "effector" may be added to the MCODE data.

(7) As still another modification, a plurality of sorts of microprograms for execution by the DSP 36 may be prestored in the ROM 4 or tone color data memory 38 so that the microprograms corresponding to the MCODE data can be transferred to a program memory within the DSP 36. In this way, roles or functions of the individual tone generator units 20-1 to 20-n can be set in response to a change in the MCODE data.

(8) Furthermore, the embodiment has been described above as arranged in such a manner that the contents of processing are changed depending on whether or not the floppy disk drive 8 is attached. As a modification, any other external storage medium, such as a flash memory or CD-ROM, may be provided, in place of or in addition to the floppy disk drive 8, for connection to the electronic piano as desired, and the contents of processing may be changed depending on whether or not the other external storage medium is attached.

In summary, the present invention arranged in the above-described manner greatly facilitates commonization of the tone generator units and the like and hence significantly reduce the designing and manufacturing costs of the tone generator units and the like.

What is claimed is:

1. An apparatus for generating or controlling a tone comprising:

a plurality of units for generating or controlling a tone; and a device that supplies common control information to each of said units, wherein each of said units includes a storage device that stores identification information defining an operation to be executed by said unit and a tone parameter related to the operation defined by the identification information, and wherein each of said unit determines, in accordance with the identification information, whether or not a tone signal based on the common control information supplied by said device is to be generated or controlled.

2. An apparatus as claimed in claim 1 wherein the control information includes event data that includes information indicative of a tone pitch of a tone to be generated.

3. An apparatus as claimed in claim 2 wherein the identification information of each of said units includes information indicative of tone pitches allotted to said unit, and wherein said unit determines whether a tone pitch of event data included in the supplied control information is among the tone pitches allotted to said unit which are indicated by the identification information.

4. An apparatus as claimed in claim 1, wherein the operations to be executed by individual ones of said units are allocated on the basis of pitch names.

5. An apparatus as claimed in claim 1 wherein said plurality of units varies in number depending on a performance grade of said apparatus, but the control information used in said apparatus can always be of same specifications irrespective of the performance grade of said apparatus.

6. A method for generating or controlling a tone by use of a plurality of units for generating or controlling a tone, said method comprising the steps of:

supplying common control information to each of said units, wherein each of said units includes a storage device that stores identification information defining an operation to be executed by said unit and a tone parameter related to the operation defined by the identification information; and causing each of said units to determine, in accordance with the identification information, whether or not a tone signal based on the control information supplied by said step of supplying should be generated or controlled.

7. A method as claimed in claim 6, wherein the operations to be executed by individual ones of said units are allocated on the basis of pitch names.

8. A method as claimed in claim 6 wherein said plurality of units to be used is variable in number, but the control information used in said method can always be of same specifications irrespective of the variable number of said units to be used.

9. A machine-readable storage medium containing a group of instructions to cause said machine to implement a method for generating or controlling a tone by use of a plurality of units for generating or controlling a tone, said method comprising the steps of:

supplying common control information to each of said units, wherein each of said units includes a storage device that stores identification information defining an operation to be executed by said unit and a tone parameter related to the operation defined by the identification information; and causing each of said units to determine, in accordance with the identification information, whether or not a tone signal based on the control information supplied by said step of supplying should be generated or controlled.

10. A machine-readable storage medium as claimed in claim 9, wherein the operations to be executed by individual ones of said units are allocated on the basis of pitch names.

11. A machine-readable storage medium as claimed in claim 9 wherein a total number of said units is variable, but the control information used has same specifications irrespective of the variable number of said units.

* * * * *